United States Patent [19]

Deane et al.

[11] 4,001,528

[45] Jan. 4, 1977

[54] TIMING MECHANISM

[75] Inventors: Kenneth E. Deane, Beech Grove; Thomas F. Ring; Bernard Malott, both of Indianapolis, all of Ind.

[73] Assignee: P. R. Mallory & Co. Inc., Indianapolis, Ind.

[22] Filed: Mar. 21, 1975

[21] Appl. No.: 560,986

[52] U.S. Cl. ..... 200/38 R; 200/35 R

[51] Int. Cl.[2] ..... H01H 43/00

[58] Field of Search ..... 200/33–39; 74/568, 569, 54, 393, 435, 437

[56] References Cited

UNITED STATES PATENTS

| | | | |
|---|---|---|---|
| 2,706,224 | 4/1955 | White | 200/39 R |
| 3,146,324 | 8/1964 | Gisiger-Stahli et al. | 200/37 R |
| 3,373,253 | 3/1968 | Davin | 200/38 R |
| 3,866,002 | 2/1975 | Underwood | 200/38 A X |
| 3,866,003 | 2/1975 | Fox | 200/39 A |
| 3,952,607 | 4/1976 | Ring | 74/393 |

*Primary Examiner*—James R. Scott
*Attorney, Agent, or Firm*—Hoffmann, Meyer & Coles

[57] ABSTRACT

A first shaft of two concentric rotatable shafts is axially displaceable with respect to the other. Switch opening and closing means is responsive to the axial displacement of the first shaft, the axial displacement being responsive to the rotational output of the second shaft. A cam means is carried by the second shaft.

9 Claims, 5 Drawing Figures

TIMING MECHANISM

Generally speaking, the present invention relates to a timing mechanism which comprises a housing; shaft means rotatably journalled in the housing, the shaft means including first and second concentric rotatable shafts, one of which is axially displaceable with respect to the other; constant speed motor drive means carried by the housing and means coupling the motor drive means to one of the first and second shafts including noncircular gear means providing a variable speed of rotation to the one shaft; a first switch means carried by the housing; switch opening and closing means axially displaceable in a first direction in response to axial displacement of the other of the first and second shafts so as to open or close the first switch means, and actuator means responsive to the variable speed of rotation of the one shaft to axially displace the switch opening and closing means in an opposite direction in a programmed sequence so as to open or close the first switch means in accordance with a programmed sequence; and cam means carried by the one shaft and second switch means opening and closing in response to the cam means.

The present invention pertains to timing mechanisms; and more particularly to an interval timer providing a variable timed output derived from a constant speed power source and wherein separate individual switching action occurs according to a preselected programmed cycle. The interval timer may be useful for a variety of applications such as timing cooking periods, sunlamp exposures, and in microwave oven applications in which it is desirable to: delay a function until a prior function is completed, to provide a variable speed output, and to indicate the termination of a time period by actuating an alarm. While for most part these functions have been performed in prior art interval times, the timer of the present invention provides means for doing so by using a combination of elements in such a manner that the timer is simple in structure, easy to fabricate, and therefore inexpensive.

It is, therefore, a feature of the invention to provide an interval timer that is simple and easy to produce. Another feature of the invention is to provide an interval timer having a variable output speed derived from a constant speed power source. Another feature of the invention is to provide an interval timer wherein the variable speed output is provided by complementary noncircular gears with a means to permit the gears to rotate past 360°. Still another feature of the invention is to provide an interval timer having a means to open or close a switch after the completion of a separate individual function. Yet still another feature of the invention is the provision of an interval timer having first and second concentric and rotatable shafts, the first shaft being axially displaceable with respect to the other and switch opening and closing means responsive to the shafts. Another feature of the invention is to provide such an interval timer wherein the switch opening and closing means is axially displaceable in a first direction in response to the axial displacement of the first shaft and wherein an actuator means axially displaces the switch opening and closing means in an opposite direction in response to the rotational output of the second shaft. Another feature of the invention is to provide such an interval timer wherein a cam means operating a second switch means is carried by the second shaft. A further feature of the invention is to provide an interval timer having an alarm device signalling the end of a cycle.

These and other features of the invention will become apparent from the following description taken in conjunction with the accompanying drawings wherein.

Figure 1:
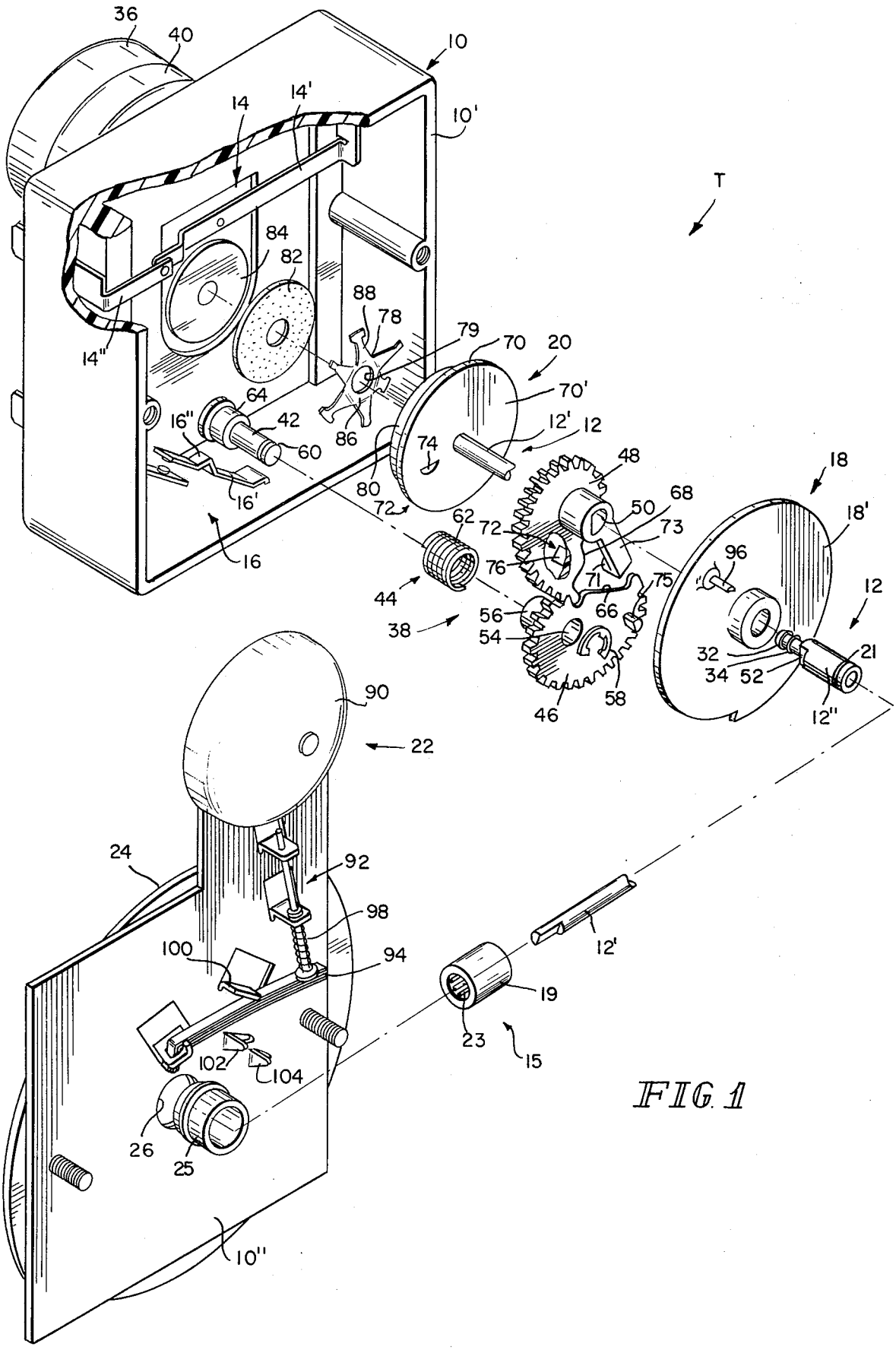
FIG. 1 is an exploded view of the interval timer of the invention.
Figure 2:
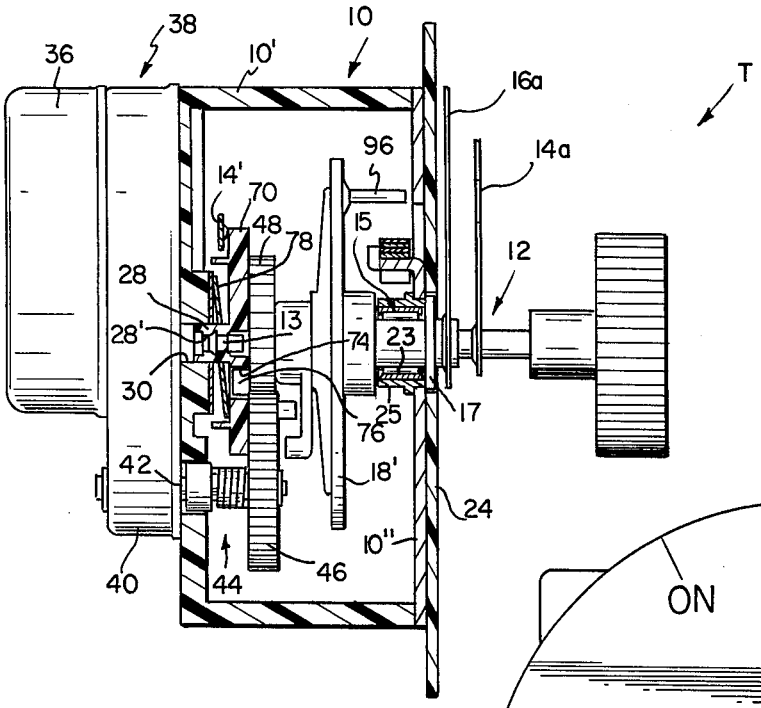
FIGS. 2 and 3 are views of the timer in elevation with portions being removed for clarity, the two views showing different operating positions of the timer.
Figure 3:
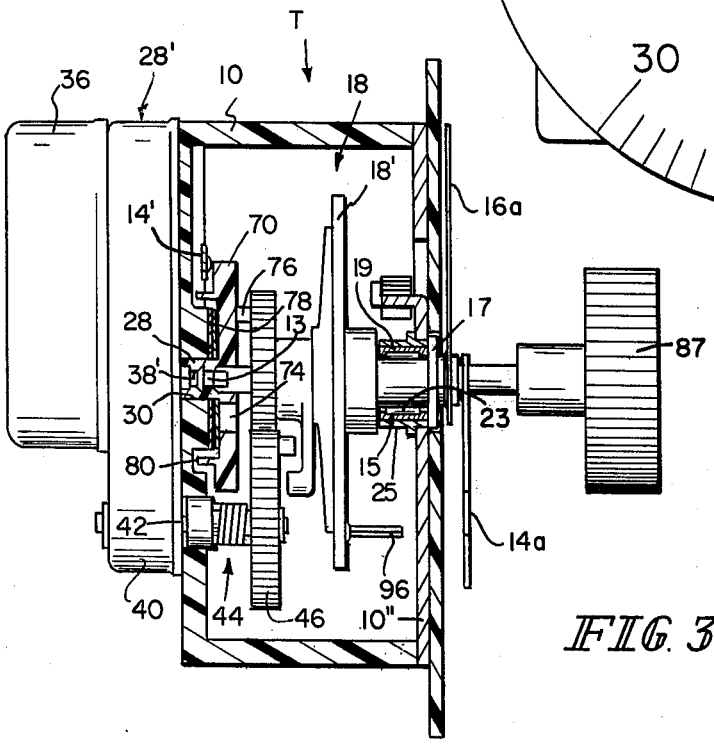
Figure 5:
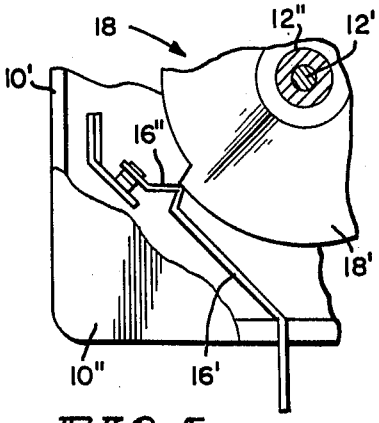
FIG. 5 is a front elevation of FIG. 4 with portions broken away.

Referring now to the drawings, the interval timer T of the invention includes, in general, housing 10, a shaft means 12, first and second switches 14 and 16, cam means 18, switch opening and closing means 20, an alarm means 22, and a dial plate 24. Housing means 10 includes a cup shaped member 10' closed by a plate 10''. Shaft means 12 includes two concentric rotatable shafts 12' and 12''. Shaft 12'' is rotatably journalled on shaft 12'. It is fixedly held from axial displacement through C-ring 17 which engages groove 21. Shaft 12' is rotatably journalled in shaft 12'' and in the base of cup shaped member 10' through hub 28 (FIGS. 2 or 3). Hub 28 is axially slideable in aperture 30 provided in the base of cup shaped member 10'. Shaft 12' is fixedly held in bore 28' of the hub through shaft extension 13. Thus shaft 12' is axially displaceable with respect to shaft 12''.

Cam means 18, in the illustrative embodiment of the timer, includes a single cam 18' which is fixedly carried on shaft 12'' by being staked thereto through ribs 32 and 34. Rotation of cam 18' opens and closes switch 16 in accordance with the movement of movable switch blade 16' through cam follower 16''. As will be hereinafter described the cycle of cam 18' is set through manual rotation of the cam. Cam 18' is prevented from a wrong-way manual rotation by a clutch means 15. Clutch means 15 is a uni-directional roller clutch manufactured by The Torrington Co, Bearings Division, Torrington, Conn. and in general includes a housing 19 having disposed therein a cooperating rollers 23 and ramps (not shown) configuration. The housing is carried on shaft 12'' and is prevented from rotation by being fixedly held on collar 25 which is fixedly held in aperture 26. Shaft 12'' is free to rotate within housing 19 in a single direction only.

A synchronous motor 36 applies power driven rotation to shaft 12'' through a means 38 coupling the motor to the shaft. Such means includes a gear train enclosed in a housing 40 and having an output shaft 42, clutch means 44, and a pair of complementary noncircular gears 46 and 48. Gear 48 is fixedly carried on shaft 12'' through the D-shaped aperture 50 which mates with the D-shaped portion 52 of the shaft. Gear 46 is independently rotatably carried on shaft 42 through aperture 54 which extends through hub 56. Axial outward movement of the gear 46 is prevented by C-ring 58 which engages detent 60. Gear 46 is coupled for rotation to shaft 42 through clutch means 44 which, as illustrated, includes a coil spring 62 which surrounds and is tightly fitted to hub 56 and collar 64 of shaft 42. Rotation of shaft 42 in a predetermined direction further tightens the coil spring on the collars.

The complementary gears 46 and 48 are noncircular to provide a variable speed of rotation to shaft 12''. As shown in the illustrative embodiment of the invention the noncircular gears are scroll gears and provide an output based on a logarithmic scale. Such a variable speed output is particularly useful in applications such as in oven controls where a slight error in timing in a small time period is very undesirable but would not be so harmful in a relatively long time period. The arrangement of the gears illustrated in the present invention is more completely described in application Ser. No. 543,782 "Variable Speed Drive Means" filed Jan. 24, 1975 now U.S. Pat. No. 3,952,607 in the name of Thomas F. Ring. As more completely described in that application the gears are able to smoothly rotate through and past 360° by virtue of the contours of the mating surface 66 and 68 which do not have gear teeth. And as further explained in the application, the teeth of the gears remain in mesh during and past such 360° rotation by virtue of lug 71 carried by arm 73 engaging boss 75 at a surface toward the teeth of the gear.

Switch opening and closing means 20 opens and closes switch 14. It includes spring biased disc 70 fixedly carried on shaft 12'' through hub 28, and actuator means 72. Spring biased disc 70 is made of an electrically insulative material. Actuator means 72 includes aperture 74 in disc 70 and pin 76 carried on gear 48. Disc 70 is axially spring biased through friction spring 78 which surrounds shaft 12' through aperture 79. The friction spring is biased between disc 70 and friction washer 82. Washer 82 is held against bearing surface 84 protruding from the base of cup shaped member 10'. Friction spring 78 includes a hub portion 86 having a plurality of fingers 88 extending therefrom, some of the fingers being biased toward friction washer 82 and the remainder being biased toward disc 70 with those fingers being nested within rim 80 extending from a face of the disc.

Switch 14 includes a movable blade 14' and a fixed blade 14'', each blade carrying an electrical contact at their distal ends and being adapted to engage one another. Manual axial displacement of shaft 12' through knob 87, which is connected to the shaft, will, as shown in FIG. 3, compress or flatten friction spring 78 and axially displace disc 70 against movable blade 14' to bias it away from fixed blade 14'' and open the switch. At or about the same time, shaft 12' is manually rotated and aperture 74 becomes misaligned from pin 76. When power driven rotation is applied to the complementary scroll gears 46 and 48, pin 76 will ride over the surface 70' of disc 70 until such time as pin 76 becomes aligned with aperture 74 at which point the disc 70, will through the axial thrust of spring 78 and the thrust of blade 14' be axially displaced and permit blade 14' to return to its original position to close switch 14. During the time that pin 76 is riding over surface 70', rotation of disc 70 and thus shaft 12' is prevented through the friction force generated between fingers 88 of spring 78 and the respective elements with which they are engaged, namely, friction washer 82 and disc 70.

Alarm means 22 indicates the end of a cycle for the timer and in general includes a bell 90, a spring biased striker 92, at least two individual spring blades 94, and a lug 96 carried by cam 18'. This arrangement wherein individual blades provide individual sounds is described in application Ser. No. 549,873. "Sound Making System" filed Feb. 14, 1975 in the name of Thomas F. Ring. As described in the application, as cam 18' is rotated, lug 96 engages spring blades 94 at their distal ends to bend them and store energy therein. Further rotation of the lug permits the blades to be individually released from the lug to permit them to engage the striker with bell 90. That is, the first blade to be released engages the striker directly while the remaining blades move the striker through the prior released blade(s). Coil spring 98 returns the striker to its original position after each striking of the bell. Tang 100 serves as a stop to prevent excessive vibration of the blades, while tangs 102 and 104 provide smooth bending of the blades as the blades are bent around them.

Figure 4:
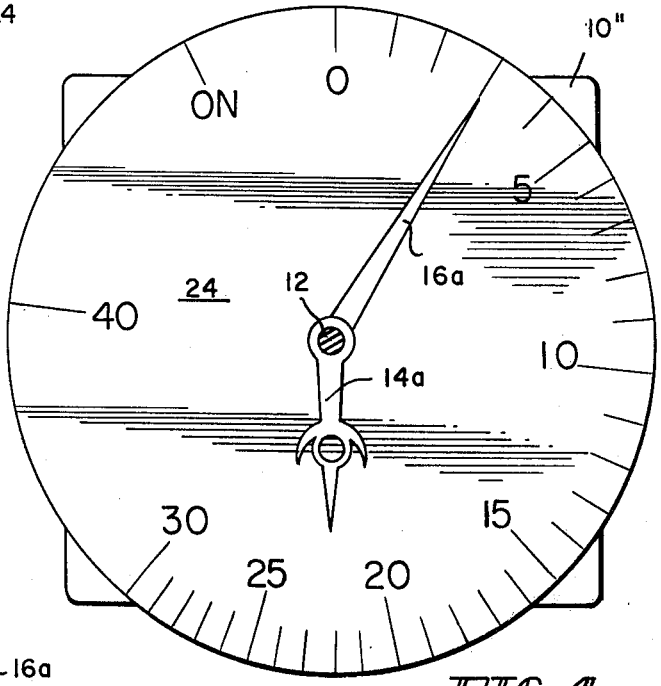
FIG. 4 is a front view of the timer.

Referring to FIG. 4, dial plate 24 has indicated thereon a logarithmic scale corresponding to the logarithmic variable speed output of shaft 12'' provided by the complementary scroll gears 46 and 48. Dial hand **14*a* indicates a cycle time for switch 14, while dial hand 16*a* indicates a cycle time for switch 16. With the dial hands thus correlated with respect to the switches and with particular reference to FIG. 2–4** the sequential operation of the timer in accordance with the embodiment shown is as follows:

1. Starting with both dial hands at '0' (previous cycle completed) the timer is OFF. At this point switch 14 is closed and switch 16 is open.

2. Both hands are manually rotated counter clockwise to the ON position, clutch 44 permitting such manual rotation independent of motor 36. At this point (at ON condition) both switches 14 and 16 are closed and motor 36 is running.

3. Dial hand **16*a* is manually set through rotation of knob 87 in a counter clockwise direction for a desired running time through rotation of knob 87. The knob is then depressed to axially displace shaft 12' to open switch 14 through disc 70 and at the same time shaft 12' is manually rotated counter clockwise to set dial hand 14*a* to the desired time at which switch 14** is closed.

4. Shaft 12'' is rotated through motor 36 to rotate cam 18' and dial hand **16*a* counter clockwise. When dial hand 16*a* is synchronized with dial hand 14*a*, pin 76 and aperture 74 in disc 70 are aligned and pin 76 engages aperture 74 (FIG. 2) and spring 78 axially displaces disc 70 and shaft 12'', with switch 14 being closed upon the displacement of disc 70**.

5. Continued counter clockwise rotation of shaft 12'' also causes counter clockwise rotation of shaft 12' until both dial hands reach '0' to again open switch 16, switch 14 remaining closed to be ready for another cycle.

If desired, switch 14 can be left open through a complete cycle merely by setting dial hand **14*a* to '0' after the depression of shaft 12' (step 3**).

In the manner previously described, rotation of cam 18' causes engagement of lug 96 with spring blades 94 to bend the blades and individually release them to sound bell 90 at a predetermined point of the cycle.

What is claimed is:

1. A timer comprising:

a. a housing, b. shaft means rotatably journalled in said housing, said shaft means including first and second concentric shafts, said first shaft axially displaceable with respect to said second shaft, c. constant speed motor drive means carried by said housing and coupling means coupling said motor drive means to said second shaft said coupling means including cooperating noncircular gear means one of which is fixedly carried by said second shaft, the other fixedly carried by an output shaft of said constant speed motor drive means, d. a first switch means carried by said housing, e. switch opening and closing means axially displaceable in a first direction in response to an axial displacement of said first shaft so as to open or close said first switch means, and actuator means responsive to the rotation of said second shaft to axially displace said switch opening and closing means in an opposite direction in a programmed sequence so as to open or close said first switch means in accordance with said programmed sequence, and f. cam means carried by said second shaft and second switch means carried by said housing opening and closing in response to rotation of said cam means.

2. A timer according to claim 1 wherein said noncircular gear means are complementary scroll gears.

3. A timer according to claim 1 wherein said switch opening and closing means includes an axially spring biased disc carried by said first shaft within said housing and engaging said first switch means.

4. A timer according to claim 3 wherein said actuator means includes an aperture in said disc, a pin carried by said noncircular gear means engaging said aperture, and spring means biasing said disc in said opposite direction.

5. A timer according to claim 4 wherein said scroll gears include mating contoured surfaces permitting said scroll gears to rotate through and past 360° and a means maintaining said gears in engagement during and past said 360° rotation.

6. A timer according to claim 1 wherein said constant speed motor drive means includes a motor, a gear train coupled to an output of said motor, said gear train including clutch means permitting manual rotation of said second shaft.

7. A timer according to claim 6 further including a dial plate carried by said housing and dial hands carried by each of said first and second shafts.

8. A timer according to claim 1 further including an alarm means and an actuator means engaging same in response to rotation of said cam means.

9. A timer comprising:

a. a housing, b. shaft means rotatably journalled in said housing, said shaft means including first and second concentric shafts, said first shaft axially displaceable with respect to said second shaft, c. constant speed motor drive means carried by said housing and coupling means coupling said motor drive means to said second shaft, d. a first switch means carried by said housing, and e. switch opening and closing means including an axially spring biased disc fixedly carried by said first shaft and engaging said first switch means so as to open or close same upon its axial displacement, and actuator means including an aperture in said spring biased disc, and a pin coupled to said second shaft, rotation of said second shaft causing engagement of said pin with said aperture to cause axial displacement of said spring biased disc so as to open or close said first switch means.

* * * * *